US006454538B1

(12) United States Patent
Witham et al.

(10) Patent No.: US 6,454,538 B1
(45) Date of Patent: Sep. 24, 2002

(54) MOTOR PROTECTOR IN POCKET ON NON-ORBITING SCROLL AND ROUTING OF WIRES THERETO

(75) Inventors: Robert Carl Witham, Arkadelphia, AR (US); Jason Hugenroth, Hope, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/827,190

(22) Filed: Apr. 5, 2001

(51) Int. Cl.[7] ..... F04B 49/10

(52) U.S. Cl. ..... 417/32; 417/410.5; 417/292; 417/307; 418/55.1

(58) Field of Search ..... 417/32, 44.2, 410.5, 417/292, 307; 418/55.1

(56) References Cited

U.S. PATENT DOCUMENTS 6,095,765 A * 8/2000 Khalifa ..... 417/310
6,267,565 B1 * 7/2001 Seibel et al. ..... 417/292

FOREIGN PATENT DOCUMENTS

GB 2360329 * 9/2001

* cited by examiner

*Primary Examiner*—Timothy S. Thorpe
*Assistant Examiner*—Michael K. Gray
(74) *Attorney, Agent, or Firm*—Carlson, Gaskey & Olds

(57) ABSTRACT

A scroll compressor is provided with a motor protector for stopping operation of its motor should conditions be indicative of a problem. The motor protector is sensitive to elevated temperature, and stops operation of the motor should a sensed temperature exceed a predetermined maximum. The motor protector is positioned in a chamber in a rear face of a base of the non-orbiting scroll. A port extends through the base of the non-orbiting scroll to connect a motor protector chamber to a suction chamber. Electric wires connect the motor protector to the motor and extend through this same port. In some embodiments, a pressure relief valve also communicates with the motor protector chamber. In one embodiment the motor protector chamber is enclosed by a cap and the pressure relief valve is mounted in that cap. In another embodiment the pressure relief valve extends through a wall of the non-orbiting scroll. In other embodiments, a pair of mating plugs connect the protector to the motor.

15 Claims, 2 Drawing Sheets

MOTOR PROTECTOR IN POCKET ON NON-ORBITING SCROLL AND ROUTING OF WIRES THERETO

BACKGROUND OF THE INVENTION

This invention relates to embodiments wherein a motor protector is positioned in the non-orbiting scroll, and the necessary wires extend through the non-orbiting scroll in a fashion such that a discharge chamber is sealed from a suction chamber around the wires.

Scroll compressors are becoming widely utilized in refrigerant compression applications. In a scroll compressor a first scroll member has a base and a generally spiral wrap extending from its base. A second scroll member has a base and a generally spiral wrap extending from its base. The wraps of the two scroll compressors interfit to define compression chambers. The second scroll member is caused to orbit relative to the first. As the two orbit relative to each other, compression chambers between the two are decreased in volume compressing an entrapped refrigerant. Typically, the scroll compressor pump unit including the two scroll members is housed within a sealed housing. The housing is typically divided into both the suction chamber and a discharge pressure chamber. The suction refrigerant leading to the compressor passes over a motor for driving the second scroll member, cooling the motor.

It is known to include a motor protector into the sealed compressor housing. Typically the motor protector has been positioned near the motor, and is operable upon sensing extreme temperature or extreme electrical characteristics to stop operation of the motor. This will protect the compressor, and will also protect any system to which the compressor is connected.

It has also been proposed to move the motor protector to a location more adjacent to the compressor pump unit. Thus, in co-pending U.S. patent application Ser. No. 09/527,428, filed Mar. 16, 2000 and entitled "Motor Protector on Non-Orbiting Scroll", it has been proposed to position the motor protector in the first scroll member base. Further, in co-pending U.S. patent application Ser. No. 09/702,623, filed Oct. 31, 2000 and entitled "Scroll Compressor With Motor Protector in Non-Orbiting Scroll and Flow Enhancement", it has been proposed to include systems for increasing the flow of discharge pressure refrigerant over the motor protector. In particular, in the event of a system fault the discharge pressure refrigerant is likely to be at an elevated temperature. Further, the refrigerant is likely to be at an elevated pressure. Thus, the above-referenced co-pending U.S. patent application Ser. No. 09/702,623 proposed associating a pressure relief valve with the motor protector.

In the proposed embodiment, the motor protector is positioned in a chamber in a rear face of the non-orbiting scroll. Further, a cap is positioned in the chamber sealing the chamber from the outside refrigerant chamber. A pressure relief valve extends through the cap, and selectively communicates discharge pressure refrigerant into the chamber if the discharge pressure exceeds a suction pressure by a predetermined amount. Pressure relief valves are known, and the pressure relief valve in this application may function as known. Should the pressure differential between the discharge and suction pressure exceed a predetermined amount, the pressure relief opens and communicates the discharge pressure refrigerant into the chamber. Since the discharge pressure refrigerant tends to be at an elevated temperature, this causes the motor protector to actuate, stopping operation of the motor.

With such systems, the electric wires must lead from the motor protector down to the motor. The routing of these wires raises some issues with regard to sealing a discharge chamber from a suction chamber.

SUMMARY OF THE INVENTION

In disclosed embodiments of this invention, a motor protector is incorporated into the non-orbiting scroll. The wires are routed from the motor protector to the motor in a way which does not lead to a leak between the discharge and suction chambers.

In the disclosed embodiment of this invention, a suction pressure tap extends through the base of the first scroll member to communicate the chamber to the suction chamber. This serves not only to provide a suction pressure force to be measured against the discharge pressure by the pressure relief valve, but further serves as a conduit for communicating the motor protector to the motor. The wires which extend from the motor protector to the motor extend through this hole in the preferred embodiment. In one embodiment, a cap encloses the chamber, and the pressure relief valve is mounted in that cap. Thus, the tap remains sealed.

In a second embodiment, the pressure relief valve extends into the chamber and through a wall of the first scroll member.

In another embodiment, the wires extend to a sealing plug which seals the area outwardly of the wires such that the wires can be routed from the protector to the motor without causing any related leakage.

These and other features of the present invention can be best understood from the following specification and drawings, the following of which is a brief description.

DETAILED DESCRIPTION OF A PREFERRED EMBODIMENT

Figure 1:
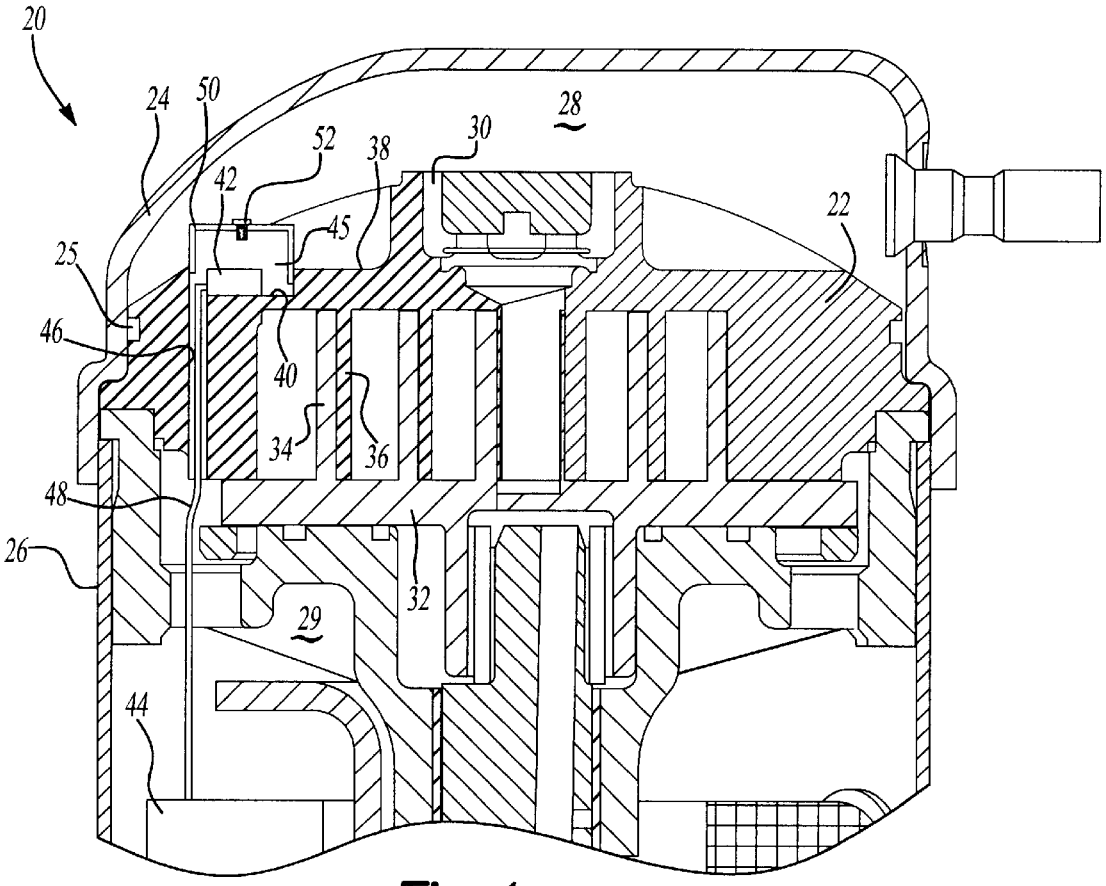
FIG. 1 is a cross-sectional view through an inventive scroll compressor.

A scroll compressor 20 is illustrated in FIG. 1 having a non-orbiting scroll 22 received within a housing end cap 24. As shown schematically, a seal 25 ensures a fluid tight seal between an outer periphery of the non-orbiting scroll 22 and the inner periphery of the housing 24. Housing 24 is attached to a center shell housing 26.

A discharge pressure chamber 28 is defined above the non-orbiting scroll 22 and a suction pressure chamber 29 is defined below. Refrigerant passes to discharge port 30 and enters chamber 28. The non-orbiting scroll 22 is associated with an orbiting scroll 32 having a generally spiral wrap 34. The generally spiral wrap 34 interfits with a generally spiral wrap 36 extending from a base 38 of the non-orbiting scroll 22. The orbiting scroll 32 is driven to orbit, as known, and as it orbits the wraps 34 and 36 move relative to each other to compress an entrapped refrigerant. This is all as known in the scroll compressor art.

A chamber 40 extends into the base 38 of the non-orbiting scroll 22. A motor protector 42 is positioned in chamber 40. A motor 44 is communicated to protector 42 by a plurality of wires 48 extending through a port 46. Port 46 extends through the non-orbiting scroll 22 and communicates the chamber 45 to the suction chamber 29. Further, the port 46 serves as a conduit for causing the wires to extend through the base of the non-orbiting scroll, ensuring the routing of the wires will not result in any fluid leakage between chambers 28 and 29.

A cap 50 is inserted into chamber 45 to provide a fluid seal between chamber 28 and the chamber 45. A pressure relief valve 52 is mounted within cap 50, and operates as known to selectively communicate discharge pressure refrigerant from chamber 28 to chamber 29 through port 46 should the pressure differential between chambers 28 and 29 exceed a predetermined maximum.

Figure 2:
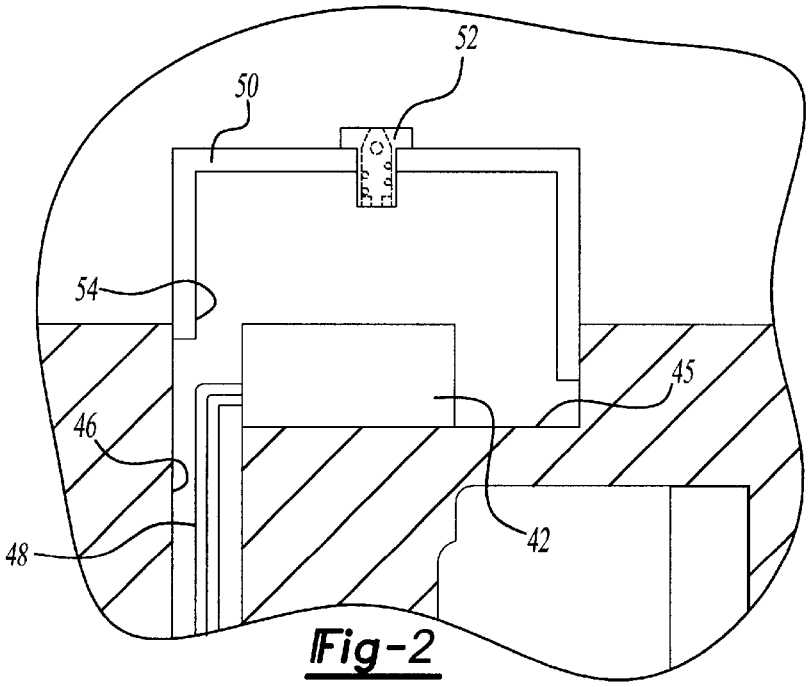
FIG. 2 shows a first embodiment.

As shown in FIG. 2, the wires 48 extend through the port 46, yet there is sufficient clearance around the wires 48 such that the chamber 29 will also be able to communicate upwardly into the chamber 45.

Figure 3:
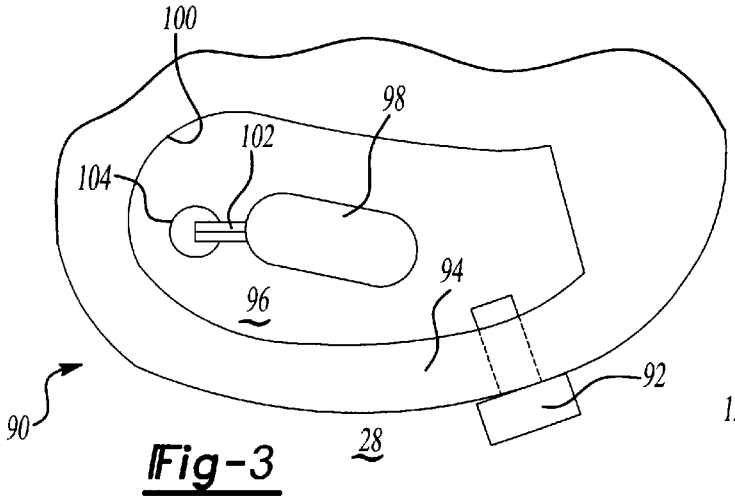
FIG. 3 shows a second embodiment.

FIG. 3 shows another embodiment 90 wherein the pressure relief valve 92 extends through a wall 94 of the non-orbiting scroll. The chamber 96 receives the motor protector 98. An inner peripheral wall 100 will receive the cap as in the prior embodiment sealing between the chambers 28 and 96. The wires 102 extend through a port 104 as in the prior embodiment.

Figure 4B:
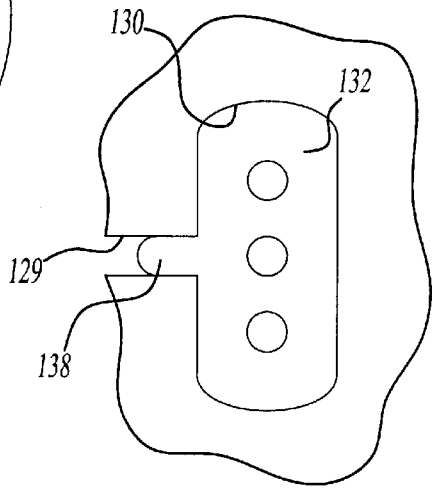
FIG. 4B shows a feature of he FIG. 4A embodiment.
Figure 4A:
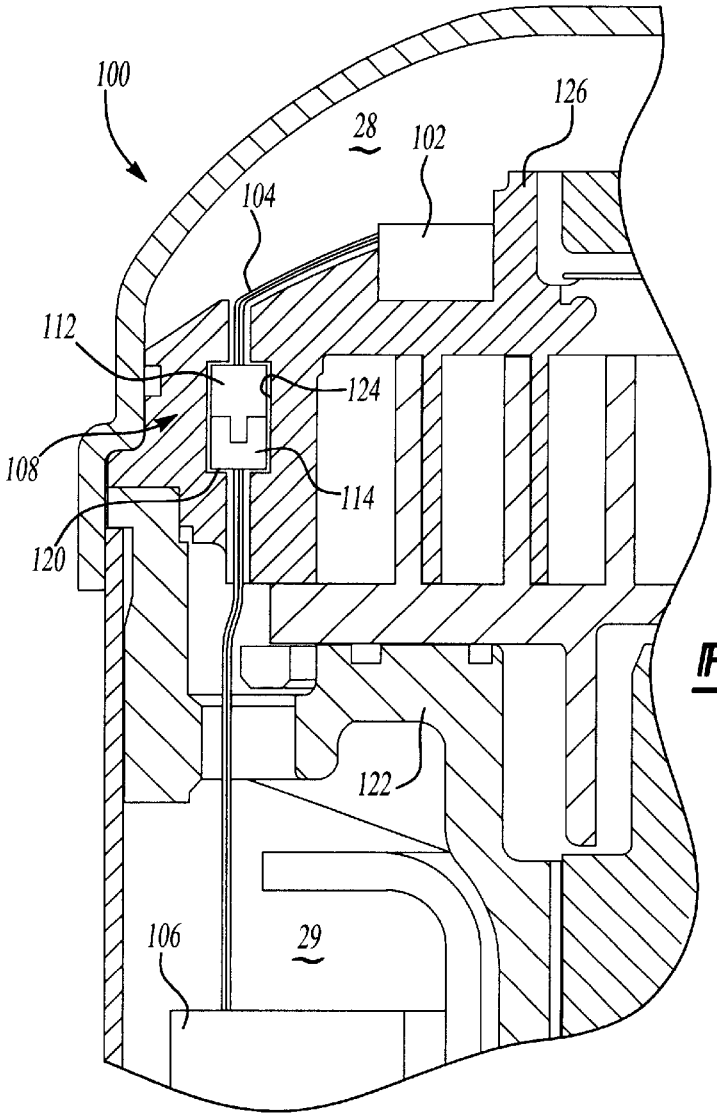
FIG. 4A shows a third embodiment.

FIG. 4A shows another embodiment 100 wherein the motor protector 102 is received in the non-orbiting scroll 126. The wires 104 extending from the motor protector are communicated to the motor 106 through a plug-in connection 108. The plug-in connection includes both a male and female plug 112 and 114, respectively. Of course, the location of the male and female plugs can be reversed from that illustrated. In the illustrated embodiment, one plug is placed in a recess 120 in the crank case 122 while the other plug is received in a recess 124 in the non-orbiting scroll 126. The connection is such that the outer periphery of the connecting plugs have an outer dimension such that they are sealed within the recesses, and such that the chamber 28 is sealed from the chamber 29. Preferably, the plugs are such that they do not become pulled apart easily.

In another feature illustrated in FIG. 4B, a slot 129 facilitates the movement of the plug portion into the recess 130. The slot may be utilized in both the non-orbiting scroll and the crank case 122. As shown at 138, by simply shaping the plug portions appropriately, slot 129 can also be successfully sealed. The purpose of the slot is to facilitate the movement of the wires and the related plug element into the recess 130.

While the preferred embodiment are all illustrated with scroll compressors wherein a rear of the non-orbiting scroll defines separation point between the discharge chamber 28 and the suction chamber 29, the above-referenced application would have benefits in scroll compressors wherein a separate separator plate is utilized.

With any of the embodiments vthe motor protector preferably is actuated by an elevated temperature to stop operation of the motor. Moreover, the motor protector preferably has circuitry such that it senses the electrical characteristics of the power being delivered to the motor 44, and will also stop operation of the motor should those characteristics be indicative of a problem somewhere in the system. Details of the motor protector may thus be as known in the art, and it is the positioning and the location of the motor protector which is inventive here.

Although preferred embodiments of this invention have been disclosed, a worker in this art would recognize that certain modifications would come within the scope of this invention. For that reason the following claims should be studied to determine the true scope and content.

What is claimed is:

1. A scroll compressor comprising:

a first scroll member having a base and a generally spiral wrap extending from said base;

a second scroll member having a base and a generally spiral wrap extending from said base, said spiral wraps of said first and second scroll members interfitting to define compression chambers, and said first scroll member having a discharge port for communicating with a discharge chamber defined by a sealed housing;

said second scroll member being driven to orbit by an electric motor, and orbiting movement of said second scroll member relative to said first scroll member causing said compression chambers to decrease in volume, compressing an entrapped refrigerant;

said sealed housing defining both a discharge pressure chamber on one side of said first scroll member and a suction pressure chamber on an opposed side of said first scroll member;

a motor protector for sensing temperature, and stopping operation of said motor if said sensed temperature exceeds a predetermined maximum, said motor protector being positioned within a chamber in a rear face of said base of said first scroll member, said chamber being isolated from said discharge port;

a pressure relief valve communicating said discharge chamber into said motor protector chamber; and a port extending through said first scroll member, electric wires connecting said motor protector to said motor and extending through said port, and said suction chamber communicating with said motor protector chamber through said port.

2. A scroll compressor as recited in claim 1, wherein said motor protector is positioned in an enlarged chamber in said rear face of said first scroll member, with said port being of a smaller cross-sectional area than said enlarged chamber.

3. A scroll compressor as recited in claim 1, wherein a cap housing member is positioned within said motor protector chamber to seal said discharge chamber from said motor protector chamber.

4. A scroll compressor as recited in claim 3, wherein said pressure relief valve is mounted within said cap.

5. A scroll compressor as recited in claim 3, wherein said pressure relief valve is positioned within said base of said first scroll member.

6. A scroll compressor as recited in claim 1, wherein said pressure relief valve is positioned within said base of said first scroll member.

7. A scroll compressor as recited in claim 1, wherein said first scroll member defines a separation area between said discharge chamber and a suction chamber surrounding said motor.

8. A scroll compressor comprising:

a first scroll member having a base and a generally spiral wrap extending from said base;

a second scroll member having a base and a generally spiral wrap extending from said base, said spiral wraps of said first and second scroll members interfitting to define compression chambers, and said first scroll member having a discharge port for communicating with a discharge chamber defined by a sealed housing;

said second scroll member being driven to orbit by an electric motor, and orbiting movement of said second scroll member relative to said first scroll member causing said compression chambers to decrease in volume, compressing an entrapped refrigerant;

said sealed housing defining both a discharge pressure chamber on one side of said first scroll member and a suction pressure chamber on an opposed side of said first scroll member;

a motor protector for sensing temperature, and stopping operation of said motor if said sensed temperature exceeds a predetermined maximum, said motor protector being positioned within a chamber in a rear face of said base of said first scroll member; and electric wires extending from said motor protector to a plug, said plug being connected to a mating plug for communicating said wires to said electric motor.

9. A scroll compressor as recited in claim 8, wherein said non-orbiting scroll including a recess in a base opposed to said rear face, said recess receiving said plug.

10. A scroll compressor as recited in claim 9, wherein a crank case supports the second scroll member, and said mating plug being received in a recess in said crank case.

11. A scroll compressor as recited in claim 10, wherein at least one of said plugs have an enlarged outer periphery to provide a seal for sealing between said discharge and suction chambers.

12. A scroll compressor as recited in claim 10, wherein each of said recesses in said crank case and said first scroll member having a generally smaller slot extending into said recess such that said plugs may be mounted into said recess by first passing said wires through said slot, and then moving said plug into said recess.

13. A scroll compressor comprising:

a first scroll member having a base and a generally spiral wrap extending from said base;

a second scroll member having a base and a generally spiral wrap extending from said base, said spiral wraps of said first and second scroll members interfitting to define compression chambers, and said first scroll member having a discharge port for communicating with a discharge chamber defined by a sealed housing;

said second scroll member being driven to orbit by an electric motor, and orbiting movement of said second scroll member relative to said first scroll member causing said compression chambers to decrease in volume, compressing an entrapped refrigerant;

said sealed housing defining both a discharge pressure chamber on one side of said first scroll member and a suction pressure chamber on an opposed side of said first scroll member;

a motor protector for sensing temperature, and stopping operation of said motor if said sensed temperature exceeds a predetermined maximum, said motor protector being positioned within a chamber in a rear face of said base of said first scroll member; and electric wires extending from said motor protector to said motor, and passing through a port in said base of said first scroll member, and a seal for sealing between said discharge pressure chambers and said port.

14. A scroll compressor as recited in claim 13, wherein a cap secures said chamber receiving said motor protector to provide said seal.

15. A scroll compressor as recited in claim 13, wherein said wires are received within a pair of mating plugs, with said mating plugs providing said seal.

* * * * *